United States Patent [19]

Horgan, Jr.

[11] Patent Number: 4,680,903

[45] Date of Patent: Jul. 21, 1987

[54] DOOR SHOE ASSEMBLY

[75] Inventor: William J. Horgan, Jr., Pittsburgh, Pa.

[73] Assignee: Blumcraft of Pittsburgh, Pittsburgh, Pa.

[21] Appl. No.: 862,994

[22] Filed: May 14, 1986

[51] Int. Cl.[4] ..... E04C 2/38

[52] U.S. Cl. ..... 52/127.8; 24/524; 52/127.11; 52/127.12; 52/397; 52/766; 52/826; 403/374

[58] Field of Search ..... 52/766, 767, 768, 826, 52/127.8, 127.11, 127.12, 397; 24/525, 524; 403/374, 409.1, 362

[56] References Cited

U.S. PATENT DOCUMENTS

| | | | |
|---|---|---|---|
| 2,583,880 | 1/1952 | Premo | 403/374 |
| 2,633,946 | 4/1953 | Huizenga | 52/826 X |
| 3,032,152 | 5/1962 | Titsler | 403/374 |
| 3,254,461 | 6/1966 | White et al. | 52/397 X |
| 3,469,823 | 9/1969 | Blum et al. | 256/65 |
| 3,516,644 | 6/1970 | Horgan, Jr. | 256/222 |
| 3,526,390 | 9/1970 | Horgan, Jr. | 256/70 |
| 3,527,443 | 9/1970 | Blum et al. | 256/70 |
| 3,528,691 | 9/1970 | Matich, Jr. | 403/409.1 X |
| 3,593,963 | 7/1971 | Horgan, Jr. | 256/24 |
| 3,722,029 | 3/1973 | Horgan, Jr. | 16/129 |
| 3,767,236 | 10/1973 | Horgan, Jr. | 403/73 |
| 3,971,186 | 7/1976 | Havelka et al. | 403/374 X |
| 4,235,056 | 11/1980 | Griffin | 52/397 |
| 4,381,578 | 5/1983 | Glejf | 403/374 X |
| 4,397,124 | 8/1983 | Redman | 52/397 X |
| 4,423,582 | 1/1984 | Yates | 52/825 |

FOREIGN PATENT DOCUMENTS

| | | | |
|---|---|---|---|
| 642049 | 5/1962 | Canada | 403/362 |
| 624232 | 8/1961 | Italy | 52/766 |

*Primary Examiner*—Alfred C. Perham
*Attorney, Agent, or Firm*—Paul & Paul

[57] ABSTRACT

A metal frame and glass panel structure comprises a metal shoe having a receiving channel therein, the receiving channel having at least one smooth side surface and an opposite side surface spaced apart from said smooth side surface; a glass panel positioned within the channel against the smooth side surface and spaced apart from the opposite side surface; at least two independent expandable pressure units positioned within the channel between the glass panel and the opposite side surface of the channel; and means within the pressure units for generating a pressure against the opposite side surface of the channel whereby the pressure units are forced against the glass panel to secure the glass panel within the channel. A pair of adjustment screws is provided in the channel, upwardly extending from the bottom thereof, for squaring the glass panel with the shoe. A strip of double-face tape is provided on the one side surface of the channel to prevent the glass panel from slipping relative to the shoe.

20 Claims, 10 Drawing Figures

DOOR SHOE ASSEMBLY

BACKGROUND OF THE INVENTION

This invention relates generally to metal frame and glass structures and more particularly to a new glazing system for such structures.

Tempered glass door and sidelight structures have recently enjoyed an increase in popularity and use, particularly in office and other commercial buildings. The popularity of such structures is primarily due to the enhanced aesthetic effect they offer over the more traditional, non-transparent door and side-light structures.

Typically, glass door and sidelights are installed in a metal frame and held therein by any one of a variety of adhesives or fixatives. These assemblies, however, require costly set-up and fixtures and require considerable skill to properly set and bond the tempered glass panel in place. Furthermore, these assemblies are particularly disadvantageous when the glass panel and metal frame is to be assembled on-site.

Mechanical-type glazing systems are also known, such as for example, U.S. Pat. No. 4,423,582 to Yates. These mechanical glazing systems typically teach the use of a continuous structure, such as for example a wedge, to apply pressure to the glass panel. The use of a continuous structure, however, presents several disadvantages. For example, a continuous structure attempts to straighten out the natural warp, bow or kink of the glass panel by spanning from high point to high point and trying to level the valley therebetween. As such, the glass panel is subjected to increased stress, thus making the glass panel more susceptible to breakage. Another disadvantage in using a continuous structure is that they tend to concentrate the load on the lower edge of the glass panel due to the distortion of the metal frame when the pressure is applied. This concentration of load, in turn, makes the glass panel more susceptible to breakage.

Still another disadvantage of the known mechanical glazing systems arises when the use of thick glass panels is desired. As the thickness of the glass panel increases, the side walls of the door shoe defining the channel become thinner in order to accomodate the thicker glass. The reduced thickness of the side walls makes the walls more susceptible to bending and breaking. When a $\frac{3}{4}$ inch glass panel is used, the side walls of the shoe have become so thin that they will no longer withstand the pressure generated against them by the glazing structure. As such, when thick glass panels are desired, a larger door shoe must be provided, which reduces the overall utility of the system.

I have invented a mechanical glazing system which overcomes the above-mentioned disadvantages of the known glazing systems by providing a plurality of independent expandable pressure units to secure the glass panel within the metal frame whereby an even pressure is exerted on the glass panel to reduce the stress on the glass. The use of independent pressure units is particularly advantageous when the thick glass panels are desired, in which case a localized recess can be made in the side wall of the channel to accomodate the panel and the pressure units without the concomitant structural impairment of the door shoe observed in the prior art systems. The present invention is also easier and cheaper to manufacture and assemble than existing glazing systems.

SUMMARY OF THE INVENTION

Accordingly, it is an object of the invention to provide a novel glazing system for use in metal frame and glass panel structures which eliminates the disadvantages of present mechanical glazing systems.

It is another object of the invention to provide a glazing systems which uses a plurality of independent expandable pressure units to hold the glass panel securely to the metal frame.

It is another object of the invention to provide a metal frame and glass panel structure which uses a least two independent expandable pressure units placed within a channel in the metal frame whereupon actuation of the units creates an even pressure on the glass panel.

It is another object of the invention to accomplish the above objects by providing a plurality of pressure units comprising pressure blocks disposed in the channel between one side thereof and the glass panel wherein said pressure blocks include adjustable pressure generating means for generating a pressure on said frame whereby said pressure blocks exert an even pressure on said glass panel.

It is a further object of the invention to provide means for preventing said glass panel from slipping on said frame.

It is a further object of the invention to provide means for facilitating the proper alignment of the glass panel within the frame.

These and other objects of the invention will become apparent upon a reading of the following detailed description of the invention with reference to the drawing figures and the appended claims.

DETAILED DESCRIPTION OF THE EMBODIMENTS

Figure 1:
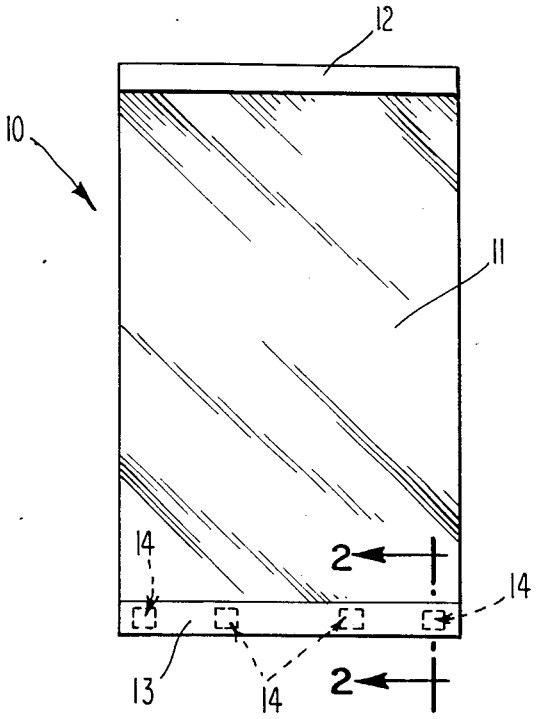
FIG. 1 is a front elevational view of a metal frame and glass panel structure, in this case a door, in accordance with the invention showing the position of the independent expandable pressure units illustrated in phantom in the bottom shoe of the door.

Referring first to FIG. 1, a metal frame and glass panel structure in accordance with the invention is shown. In the embodiment shown, the metal frame and glass panel structure is a door 10 which comprises a glass panel 11 and top and bottom metal shoes 12 and 13, rspectively. As seen in FIG. 1, metal shoes 12,13 are elongate rigid structures extending the entire width of the glass panel 11. Metal shoes 12,13 are preferably made of aluminum or brass for aesthetic purposes, although it is to be understood that other metals are also suitable. Furthermore, it is to be understood that shoes 12,13, although preferably constructed as a continuous metal extrusion, may be made of smaller metal extrusions fitted together so as to form a substantially continuous piece. Also shown in FIG. 1, illustrated in phantom in bottom shoe 13, are a plurality of independent expandable pressure units 14 which are more fully described below.

Figure 2:
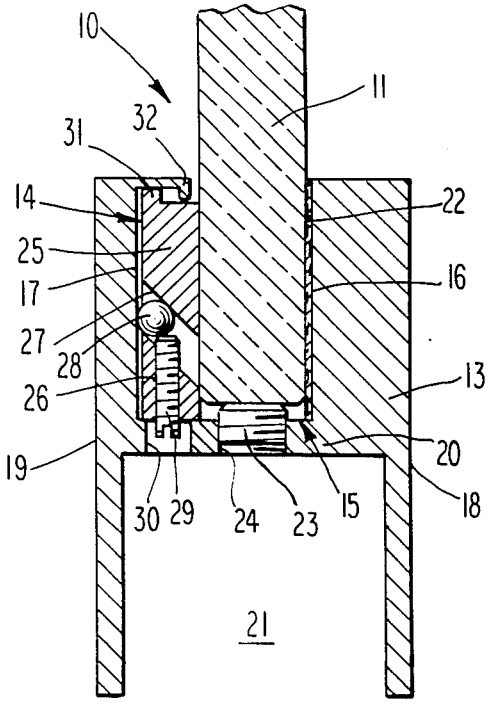
FIG. 2 is an enlarged sectional view of the invention taken along line 2—2 of FIG. 1.
Figure 3:
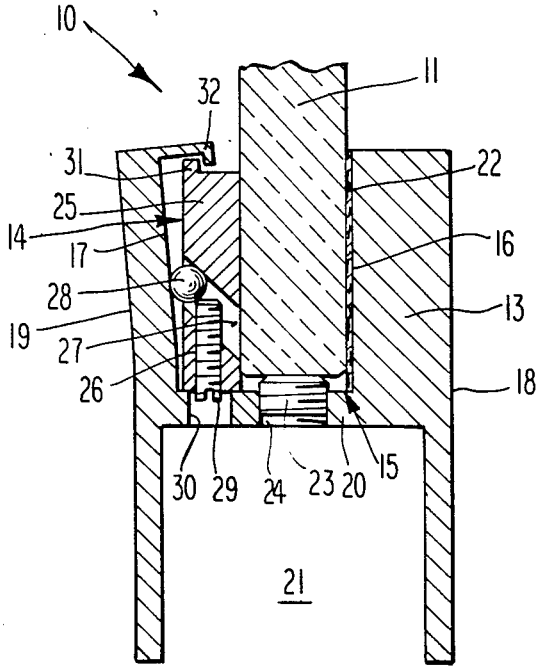
FIG. 3 is an enlarged sectional view of the invention as in FIG. 2, showing the frame and glass panel in the assembled condition with the pressure units shown in expanded condition and the distortion of shoe being exaggerated for purposes of illustration.

With reference to FIGS. 2 and 3, the cooperation of the various elements comprising the invention is clearly illustrated therein, particular reference being made to bottom shoe 13 although it is to be understood that the following applies equally to top shoe 12 of structure 10. As seen in FIG. 2, bottom shoe 13 is provided with an open channel 15 which extends longitudinally through shoe 13. In the embodiment shown in FIGS. 2 and 3, channel 15 is provided with substantially parallel, spaced apart side surfaces 16,17 which are substantially parallel to the faces 18,19 of shoe 13. Bottom wall 20 of channel 15 separates the channel from web opening 21 of shoe 13.

Although the embodiment illustrated in FIGS. 2 and 3 is shown as having a substantially H-shaped metal shoe, it is to be understood that other suitable shapes are also possible. Furthermore, it is to be understood that side surfaces 16,17 need not be parallel to one another and side surface 16 need only be smooth and disposed substantially parallel to the plane of the glass panel.

Glass panel 11 is positioned within channel 15 against one side surface thereof, such as side surface 16, and spaced apart from the other side surface 17. A strip of adhesive, such as double-faced tape 22 may be provided, if desired, along the side surface 16 adjacent to the glass panel 11 to prevent any slip between the glass panel 11 and the shoe 13.

The adhesive material also provides a compressible cushion against the glass panel which will follow the natural bow, warp or kink of the glass panel when the glass panel is forced against the side surface 16, as described below, and thus reduces the stress on the glass panel.

It may also be desirable to adjust the vertical position of glass panel 11 relative to shoe 13, such as for example when it is desired to square the glass panel with the shoe. To this end, adjustement screws 23 (only one being shown) are provided in the channel 15. The adjustment screws 23, which are preferably plastic, are disposed within tapped bores 24 in bottom wall 20 and extend upwardly into channel 15. The adjustment screws 23 are positioned so as to be underneath and in contact with glass panel 11 in channel 15. It is preferable to position adjustment screws 23 near the longitudinal ends of channel 15 so that upon proper adjustment of the screws, glass panel 11 may be adjusted vertically relative to bottom wall 20 of channel 15 to square the glass panel 11 properly with shoe 13.

Positioned within channel 15 between the glass panel 11 and the other side surface 17 of the channel are at least two pressure units 14 in spaced apart relation to one another (see FIG. 1). Pressure units 14, as more fully described hereinafter, for independent expandable pressure units for retaining the glass panel 11 within the channel 15 of door shoe 13. The number of pressure units used in a particular structure is a function of the width of the glass panel and shoe, it being understood that at least two pressure units are required for the proper functioning of the invention. The pressure units are preferably spaced 4 to 6 inches apart on center.

Figure 4:
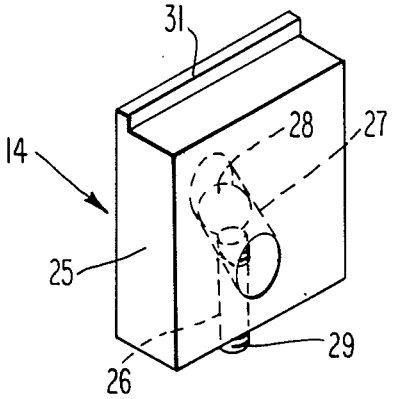
FIG. 4 is a perspective view of the independent expandable pressure unit of the invention showing the ball and screw arrangement therein.
Figure 6:
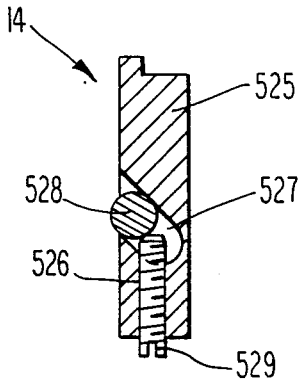
FIG. 6 is a sectional view of the embodiment of the pressure unit of FIG. 5 taken along line 6—6 of FIG. 5.
Figure 7:
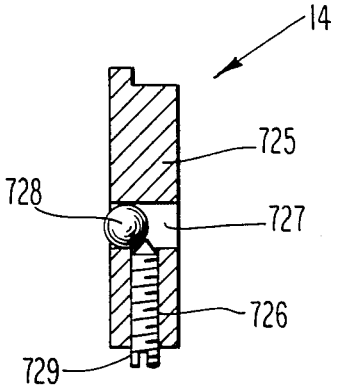
FIG. 7 is a sectional view of still another embodiment of the pressure unit of the invention wherein the transverse bore is perpendicular to the tapped bore and the screw is cone-pointed.
Figure 8:
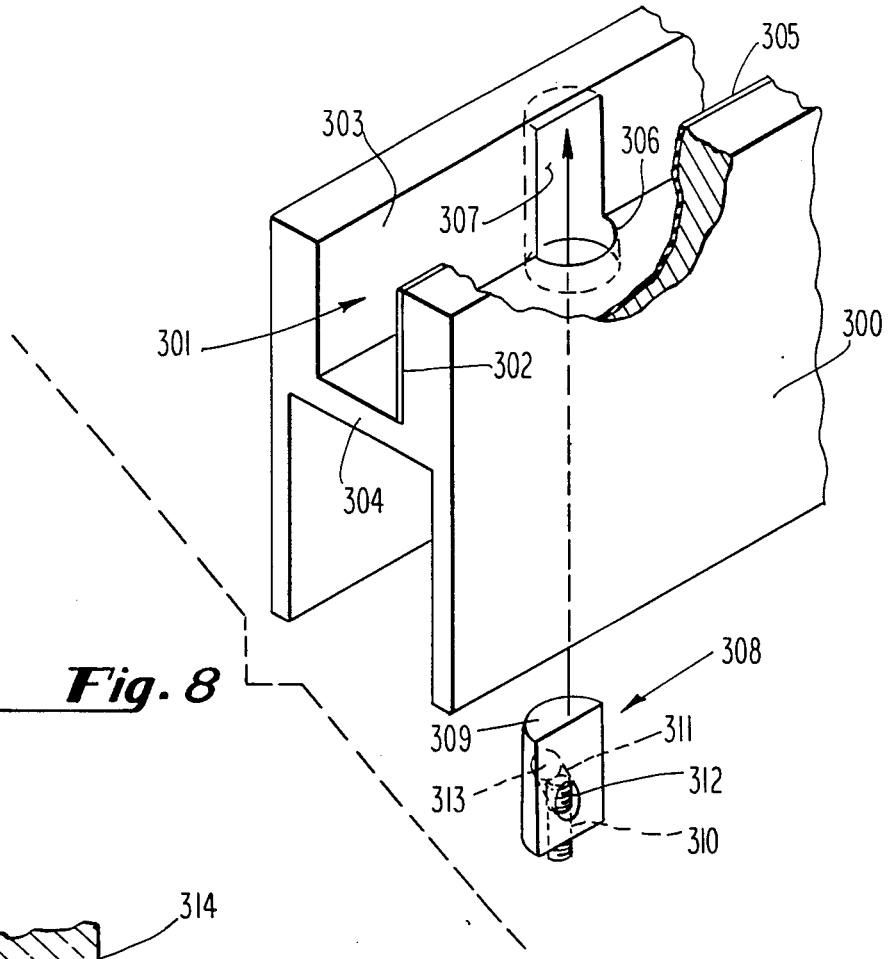
FIG. 8 is an exploded perspective view of a preferred embodiment of the invention shown partially broken away to illustrate placement of the pressure unit in the channel.
Figure 9:
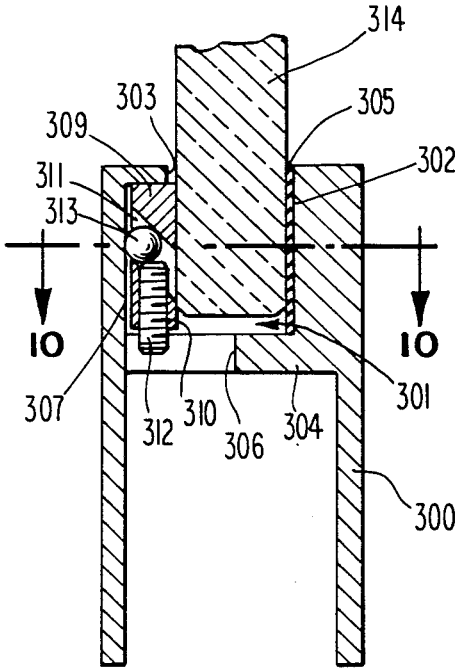
FIG. 9 is a sectional view of the preferred embodiment of the invention in assembled form.
Figure 10:
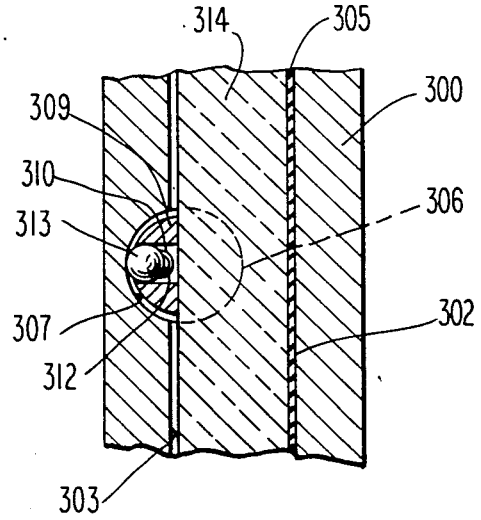
FIG. 10 is a sectional view of the preferred embodiment and taken along line 10—10 of FIG. 9.

FIGS. 8–10 illustrate a preferred embodiment of the invention with various other embodiment of the pressure units 14 being illustrated in FIGS. 2–7. With reference first being made to the embodiment of FIG. 4, pressure unit 14 comprises a pressure block 25 which is illustrated as being of generally flattened cubicial shape, it being understood that other shapes are also suitable, such as that shown in FIGS. 8–10. Pressure block 25 is provided with a vertically extending tapped bore 26 and a transverse bore 27 which intersects with tapped bore 26. Disposed within transverse bore 27 for sliding movement therein is ball 28 which is sized so as to be closely received within transverse bore 27. An adjustment screw 29 is disposed within tapped bore 26 and is sized so as to contact ball 28 in transverse bore 27 and move ball 28 within the transverse bore when screw 29 is advanced within tapped bore 26. As seen in FIGS. 2–4, transverse bore 27 is preferably angled upwardly towards side surface 17 of channel 15 when pressure unit 14 is disposed within the channel.

Figure 5:
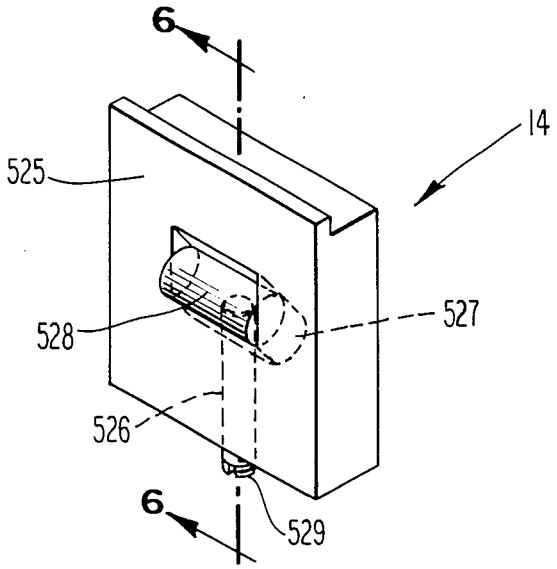
FIG. 5 is a perspective view of another embodiment of the independent expandable pressure unit of the invention as seen from the opposite side of the unit from that in FIG. 4 and showing the cylinder and screw arrangements.

With reference to FIGS. 5 and 6, another embodiment of the pressure unit 14 is illustrated and comprises a pressure block 525 having a vertical tapped bore 526 and a transverse concave recess 527 of substantially U-shape configuration. A cylindrical member 528 is slidably disposed within transverse recess 527 and is of such diameter that cylinder 528 is closely received within the transverse recess. An adjustment screw 529 is disposed within the tapped bore 526 which, when advanced within the tapped bore, will ush cylinder 528 outwardly from transverse recess 527.

With reference to FIG. 7, still another embodiment of the pressure unit 14 is illustrated as comprising a pressure block 725 having a vertical tapped bore 726 and a transverse bore 727 which intersects tapped bore 726. A ball 728 is slidably disposed in and closely received by transverse bore 727. An adjustment screw 729 is disposed within tapped bore 726 which will push all 728 outwardly from transverse bore 727 when advanced within tapped bore 726. In the particular embodiment illustrated in FIG. 7, transverse bore 727 is perpendicular to tapped bore 726 and adjustment screw 729 is a cone-pointed screw.

As seen from the Figures, the element disposed within the transverse opening, whether it be a ball or a cylinder, is of substantially circular cross-sectional shape which is required to provide a pivotal contact with side surface 17 of channel 15 and the walls of the transverse opening in the pressure block 25 which, in turn, assures an even pressure contact between pressure block 25 and glass panel 11. The modifications illustrated for the configuration of the transverse opening and the adjustment screw are then dependent upon the type of element to be used to provide the pivotal contact.

With particular reference again to FIGS. 2–4, pressure units 14 are positioned within channel 15 in the space between glass panel 11 and side surface 17. Adjustment screw 29 projects into an oversized aperture 30 in bottom wall 20. The aperture 30 is oversized to facilitate the positioning of pressure unit 14 in channel 15 and to facilitate the adjustment of screw 29 when the pressure units are in position. Pressure block 25 is preferably provided with an upwardly projecting flange 31 which extends substantially across the top surface of pressure block 25. Flange 31 cooperates with an inwardly and then downwardly projecting cover lip 32 of side surface 17 of channel 15 to help retain the pressure blocks 14 in position during assembly. As seen in the figures, cover lip 32 is preferably formed continuous with shoe 13 for aesthetic purposes.

The assembly of the invention will now be described with reference to the embodiments illustrated in FIGS. 2–7. First, the strip of double-faced tape 22 is applied to side surface 16 of channel 15 leaving the protective cover on the side of the tape that is to be adhered to the glass panel 11. Pressure units 14 including pressure blocks 15, ball 28 and screw 29 are then positioned within channel 15 with the ball 28 being substantially disposed within transverse bore 27 as seen in FIG. 2. Ball 28 may temporarily be held in place by a drop of silicone sealant (not shown), if desired. Pressure units 14 are loosely held in place by screw 29 in oversized hole 30 and by the flange 31 and cover lip 32 configuration mentioned above. Glass panel 11 is then positioned within channel 15 and is squared with shoes 12 and 13 by adjusting screws 23. Glass panel 11 is then removed from the channel, and the protective cover of the double-faced tape strip 22 is removed. Glass panel 11 is again placed within channel 15 and screw 29 is advanced within tapped bore 26. The advancement of screw 29 causes ball 28 to slide within transverse bore 27 upwardly and outwardly towards side surface 17 to expand pressure unit 14, thereby forcing pressure block 25 against glass panel 11 which is turn is forced against tape 22 and side surface 16 whereby glass panel 11 is secured within channel 15.

As seen in FIG. 3, the localized pressure created by the advancement of ball 28 against side surface 17 will cause side surface 17 to distort outwardly, the degree of distortion being a function of the yield characteristics of the metal used for the shoe. Despite the distortion in side surface 17, the pressure transmitted by pressure block 25 to glass panel 11 will always be evenly distributed on glass panel 11 due to the pivoting connections between ball 28, side surface 17, and pressure block 25 along transverse bore 27. Thus, a localized pressure is created on side surface 17 by ball 28 and this localized pressure is transmitted to a force on the glass panel which is evenly distributed along the surface of contact between the pressure block 25 and the glass panel 11.

As can be seen in FIGS. 2 and 3, the advancement of ball 28 towards side surface 17 in effect expands the dimensions of pressure block 25 in the lateral directions. It is also evident from the Figures that pressure blocks 25 remain stationary in the vertical directions and substantially stationary in the lateral directions when the ball 28 is abvanced in transverse bore 27.

With reference to FIGS. 8–10, the preferred embodiment of the invention comprises a door shoe 300 having a channel 301 therein, with the channel 301 having side surfaces 302,303 and a bottom wall 304. Side surface 302 may be provided with double-faced tape 305, if desired. A circular bore 306 is provided through bottom wall 304 and intersects with side surface 303 whereby a concave, semicylindrical recess 307 is formed in side surface 303 of channel 301. The cylindrical recess 307 is sized so as to receive pressure unit 308.

Pressure unit 308, as seen in FIG. 8, comprises a semi-cylindrical pressure block 309 having a vertical tapped bore 310, a transverse bore 311 intersecting with tapped bore 310, and a screw 312 disposed within tapped bore 310. A ball 313 is slidingly disposed within transverse bore 311 and is movable within the transverse bore 311 in response to the adjustment of screw 312.

The assembly of the preferred embodiment, as illustrated in FIGS. 9 and 10, is similar to that described above. As seen in the Figures, a glass panel 314 is positioned within channel 301 and against the double-faced tape 305 on the side surface 302. The pressure block 309 is then inserted through circular bore 306 into semicylindrical recess 307. Screw 312 is then adjusted to move ball 313 outwardly, whereby glass panel 314 is secured within channel 301.

In the preferred embodiment just described, it can be seen that the structural integrity of the side surface 303 of the shoe 300 is maintained, even in the presence of a thick glass panel, by providing only a localized recess in the side surface to accomodate the pressure unit 309. In the case of a thinner glass panel, the position of circular bore 306 is moved toward the center of channel 301 so that pressure unit 308 is in the proper position to secure the glass panel in place.

Although not illustrated, it is to be understood that the preferred embodiment of the invention may also be provided with adjustment screws, such as screws 23 in FIGS. 2 and 3, to square the glass panel with the shoe.

As the foregoing description illustrates, the invention provides a new and useful glazing system for metal frame and glass panel structures wherein the use of at least two independent expandable pressure units within a channel of the frame securely retain the glass panel within the frame without creating excessive stresses in the glass panel which would otherwise make the glass panel more susceptible to breakage.

Preferred form of the invention have been described and shown herein for purposes of illustration only and not for purposes of limitation, and various modifications or alterations may suggest themselves to those skilled in the art, all of which are within the scope of the invention as defined in the appended claims.

What is claimed is:

1. A metal frame and glass panel structure comprising:

(a) a metal shoe having a channel therein, said channel having at least one smooth side surface and an opposite side surface spaced apart from said smooth side surface;

(b) a glass panel positioned within said channel against said smooth side surface and spaced apart from said opposite side surface; and (c) a plurality of independent expandable pressure units disposed within said channel for retaining said glass panel in said channel, each of said pressure units comprising:

(1) a pressure block disposed within said channel between said glass panel and said opposite side surface; and (2) adjustable pressure generating means within said block for laterally expanding said pressure unit to simultaneously create pressure on said opposite side surface and an even pressure on said glass panel, whereby said glass panel is forced against said smooth side surface to secure said glass panel within said channel.

2. The structure of claim 1, wherein said adjustable pressure generating means comprises:

(a) a vertically extending tapped bore in said pressure block;

(b) a transverse opening interesecting said tapped bore;

(c) movable means within said transverse opening; and (d) an adjustment screw disposed within said tapped bore contacting said movable means for moving same within said transverse opening.

3. The structure of claim 2, wherein said movable means is circular in cross-section.

4. The structure of claim 2, wherein said movable means is a ball slidably disposed within said transverse opening.

5. The structure of claim 2, wherein said transverse opening is a transverse bore upwardly angled towards said opposite side surface of said channel.

6. The structure of claim 1, wherein said opposite side surface includes a cover portion having a downwardly projecting lip and said pressure block include an upwardly extending flange, wherein said lip and said flange comprise means for retaining said pressure block within said channel.

7. The structure of claim 1, further comprising a pair of adjustment screws for vertically adjusting said glass panel to square said glass panel with the metal shoe.

8. The structure of claim 1, further comprising a strip of double-faced tape positioned between said glass panel and said smooth side surface to prevent relative slip between said glass panel and said metal shoe.

9. A metal frame and glass panel structure comprising:

(a) a metal shoe having a channel therein, said channel having at least one smooth side surface and an opposite side surface spaced apart from said smooth side surface;

(b) a glass panel positioned within said channel against said smooth side surface and spaced apart from said opposite side surface; and (c) a plurality of independent expandable pressure units disposed within said channel for retaining said glass panel in said channel, each of said pressure units comprising:

(1) a pressure block disposed within said channel between said glass panel and said opposite side surface, wherein the surfaces of said pressure block adjacent said glass panel and said opposite side surface are substantially parallel to one another; and (2) adjustable pressure generating means for laterally expanding said pressure units to simultaneously create pressure on said opposite side surface and an even pressure on said glass panel, whereby said glass panel is forced against said smooth side surface to secure said glass panel within said channel.

10. The structure of claim 9, wherein said adjustable pressure generating means comprises:

(a) a vertically extending tapped bore in said pressure block;

(b) a transverse opening intersecting said tapped bore;

(c) movable means within said transverse opening; and (d) an adjustment screw disposed within said tapped bore contacting said movable means for moving same within said transverse opening.

11. The structure of claim 10, wherein said movable means is circular in cross-section.

12. The structure of claim 10, wherein said movable means is a ball slidably disposed within said transverse opening.

13. The structure of claim 10, wherein said transverse opening is a transverse bore upwardly angled towards said opposite side surface of said channel.

14. A metal frame and glass panel structure comprising:

(a) a metal shoe having a channel therein, said channel having at least one smooth side surface and an opposite side surface spaced apart from said smooth side surface;

(b) a glass panel positioned within said channel against said smooth side surface and spaced apart from said opposite side surface; and (c) a plurality of independent expandable pressure units disposed within said channel for retaining said glass panel in said channel, each of said pressure units comprising:

(1) a pressure block disposed within said channel between said glass panel and said opposite side surface; and (2) adjustable pressure generating means within said pressure block for laterally expanding said pressure unit to simultaneously create pressure on said opposite side surface and said glass panel, whereby said glass panel is forced against said smooth side surface to secure said glass panel within said channel, wherein said pressure block is not vertically displaced when said pressure units are expanded.

15. The structure of claim 14, wherein said adjustable pressure generating means comprises:

(a) a vertically extending tapped bore in said pressure block;

(b) a transverse opening intersecting said tapped bore;

(c) movable means within said transverse opening; and (d) an adjustment screw disposed within said tapped bore contacting said movable means for moving same within said transverse opening.

16. The structure of claim 15, wherein said movable means is circular in cross-section.

17. The structure of claim 15, wherein said movable means is a ball slidably disposed within said transverse opening.

18. The structure of claim 15, wherein said transverse opening is a transverse bore upwardly angled towards said opposite side surface of said channel.

19. A metal frame and glass panel structure comprising:

(a) a metal shoe having a channel therein, said channel having smooth side surfaces in substantially parallel spaced-apart relation to one another;

(b) a glass panel positioned within the channel against one smooth side surface thereof and spaced apart from the other side surface;

(c) at least two pressure blocks disposed within said channel between said glass panel and said other side surface; and (d) adjustable pressure generating means within said pressure blocks for generating a simultaneous pressure against said other side surface and said glass panel, said means comprising:

(1) a vertically extending tapped bore in said pressure blocks;

(2) a transverse bore intersecting said tapped bore, said transverse bore being upwardly angled towards said other side surface;

(3) a ball slidingly disposed within said transverse bore; and (4) an adjustment screw within said tapped bore contacting said ball for moving same within said transverse bore, wherein said pressure blocks are not vertically displaced when said adjustable pressure generating means is actuated.

20. The structure of claim 19, further comprising a strip of double-faced tape positioned between said glass panel and said one side surface of said channel and a pair of adjustment screws for vertically adjusting said glass panel to square the glass panel with the metal shoe.

* * * * *